US007520717B2

(12) United States Patent
Kindl et al.

(10) Patent No.: US 7,520,717 B2
(45) Date of Patent: Apr. 21, 2009

(54) SWIRL GENERATOR FOR A RADIAL COMPRESSOR

(75) Inventors: Helmut M. Kindl, Aachen (DE); Norbert A. Schorn, Aachen (DE); Uwe R. Spaeder, Aachen (DE); Rob Stalman, Selfkant (DE)

(73) Assignee: Ford Global Technologies, LLC, Dearborn, MI (US)

( * ) Notice: Subject to any disclaimer, the term of this patent is extended or adjusted under 35 U.S.C. 154(b) by 545 days.

(21) Appl. No.: 11/217,826

(22) Filed: Sep. 1, 2005

(65) Prior Publication Data

US 2006/0042588 A1 Mar. 2, 2006

(30) Foreign Application Priority Data

Sep. 1, 2004 (EP) ..... 04104182

(51) Int. Cl.
*F04D 29/46* (2006.01)

(52) U.S. Cl. ..... 415/159; 415/184; 415/191; 415/208.2

(58) Field of Classification Search ..... 415/159, 415/184, 185, 205, 208.2
See application file for complete search history.

(56) References Cited

U.S. PATENT DOCUMENTS

| | | | | |
|---|---|---|---|---|
| 2,671,406 | A * | 3/1954 | Waller | 415/205 |
| 4,780,055 | A * | 10/1988 | Zloch et al. | 415/160 |
| 5,368,440 | A | 11/1994 | Japikse et al. | |
| 5,730,580 | A | 3/1998 | Japikse | |
| 6,520,738 | B2 * | 2/2003 | Sheoran et al. | 415/205 |
| 2003/0150212 | A1 | 8/2003 | Rutschmann et al. | |

FOREIGN PATENT DOCUMENTS

| | | |
|---|---|---|
| DE | 10250302 | 12/2004 |
| EP | 0243596 | 5/1991 |

* cited by examiner

*Primary Examiner*—Ninh H Nguyen

(57) ABSTRACT

The invention relates to a radial compressor having a suction-side opening and a pressure side. A swirl generator is placed upstream of the radial compressor. The swirl generator, has an inlet portion which is angularly configured relative to the outlet opening, the outlet opening facing the suction-side opening of the swirl generator. The swirl generator further has adjustable baffle plates arranged concentrically around the outlet opening.

5 Claims, 2 Drawing Sheets

SWIRL GENERATOR FOR A RADIAL COMPRESSOR

FIELD OF INVENTION

The invention relates to a turbocharger for an internal combustion engine, and in particular to a radial compressor with an improved swirl generator.

BACKGROUND AND SUMMARY OF THE INVENTION

Radial compressors are used, for example, as turbochargers in motor vehicle engines. The construction space which is available in present-day vehicle development is severely limited due to the ever increasing number of additional assemblies and further restrictions arising from pedestrian protection or crash safety requirements. The result is that engine components, lines and air-carrying pipes compete with other components and structural parts for the respectively ideal location. In modern engine construction, the additional assemblies also include exhaust-gas turbochargers, which serve to boost the specific power output and torque in order to enhance the joy of driving and, at the same time, offer prospects for reduced emissions. Associated with turbochargers and boost concepts are other components, such as, for example, charge-air coolers, control valves and additional air pipe installations, which additionally aggravate the construction space situation.

Some typical prior art systems are discussed below:

In DE 102 50 302 A1, a swirl-generating device for the swirl-subjected flow against a compressor impeller of a compressor having a compressor housing and a charge-air suction line is disclosed. A swirl generator is provided, which can be inserted into the compressor housing and/or into the charge-air suction line and is placed in front of the compressor impeller. Viewed in cross section, the charge-air suction line is of rectilinear construction, so that the compressor is flowed against in the axial direction.

US 2003/0150212 A1 relates to an exhaust-gas turbocharger for an internal combustion engine having a turbine and compressor housing, in which there is respectively disposed a turbine and a compressor wheel, mutually connected by a shaft. The turbine housing has a spirally running inlet duct for the exhaust gases. In the inlet duct, a redoubt-like projection is provided for flow deflection purposes on the inner wall of the inlet duct so as to taper the duct cross section of the spiral inlet duct and then widen it as far as a tongue which closes off the inlet duct. The redoubt-like projection is configured as a wall reinforcement of the turbine housing.

EP 0 243 596 B1 discloses an axial swirl control for an exhaust-gas turbocharger for combustion engines with radial compressor. The radial compressor consists of an axial guide mechanism with a ring of guide blades extending radially to the charger axis and pivotable about radially aligned rotational axes, which guide blades consist essentially of circular sectors of such shape and division that, when the guide mechanism is fully closed, they almost totally cover the cross section of a flow duct and are disposed in the flow duct in a housing. The inner wall of the housing comprises, viewed in the direction of flow, a first casing of a cylindrical portion, a casing of a spherical portion, and a second cylindrical portion of lesser radius. The spherical radius of the spherical portion is equal to the radius of the first cylindrical portion. On the shafts of the unilaterally mounted guide blades, which shafts jut outward along the rotational axes, there are disposed adjusting levers, which engage in an adjusting ring concentrically enclosing the housing. The spherical portion passes in the shape of a nozzle into the second cylindrical portion. The rotational axes of the guide blades lie respectively in the blade leading edge. The transition of the housing casing from the first cylindrical portion to the spherical portion lies in the plane of the rotational axes of the guide blades.

U.S. Pat. No. 5,368,440 discloses a radial turbo engine with a rotor having a rotational axis. A diffuser has a plurality of airfoil baffle plates, which have a pressure side and a suction side. The pressure side is directed away from the rotational axis, while the suction side is orientated toward the rotational axis. At least some of the airfoil baffle plates have an angle of incidence which is substantially equal to or less than an angle of incidence corresponding to a traditional structure of pressure-sided separation flows of the airfoil baffle plates.

U.S. Pat. No. 5,730,580 discloses a turbo engine. The turbo engine comprises a set of baffle plates comprising a plurality of baffle plates arranged in a circular line, a first portion of the baffle plates being configured as "rogue" baffle plates and a second portion of the baffle plates being configured as normal baffle plates. For a given flow through the baffle plate set, the angle of incidence of the "rogue" baffle plates is different than the angle of incidence of the normal baffle plates.

The inventors herein have recognized that the construction space conditions frequently give rise to pipe installations and geometric configurations of compressor intakes which partially fail to meet the requirements of an ideal axial approach flow and circular cross sections. For instance, the pressure distribution and velocity distribution directly in front of the compressor intake and the compressor wheel differ markedly from perfectly even distributions. This can lead to irregularities in the approach flow and to local flow separations, especially at the compressor wheel, in which case the compressor output is adversely affected by the non-uniformity.

The above disadvantages can be overcome by a turbocharger system for an internal combustion engine, including: a radial compressor having a suction-side opening; and a swirl generator comprising an outlet portion facing said suction-side opening of said radial compressor, and an inlet portion angularly configured relative to said outlet portion, said swirl generator further comprising adjustable baffle plates arranged concentrically around said outlet portion.

According to the present invention, a compact configuration of the swirl generator with bends and integrated pre-swirl generation is provided, the configuration of the swirl generator giving due consideration to the limited construction space conditions within the engine compartment by taking up relatively little construction space. In addition, an enveloping compressor characteristic diagram of all swirl settings is widened, the surge limit of the compressor being shifted by the swirl to smaller mass flows. Therefore, the drivability of motor vehicles, with regard to torques in the lower region of the vehicle engine, the rated power of the engine and the acceleration characteristics, is significantly improved.

In one aspect of the present invention, the swirl generator, with its inlet portion, has a first region, which, viewed in longitudinal section, is of substantially rectangular configuration, the first region passing into a second region, which, viewed in longitudinal section, is of substantially round configuration, the outlet opening, which, viewed in longitudinal section, is of circular configuration, being made in the second region.

In another aspect of the present invention, the swirl generator, viewed in longitudinal section, is configured as a spiral housing.

In a preferred embodiment, the swirl generator has an intake cross-sectional area which corresponds to a discharge cross-sectional area. The outlet opening has an outlet diameter corresponding to an inlet diameter of the suction-side opening.

The above advantages and other advantages, and features of the present invention will be readily apparent from the following detailed description of the preferred embodiments when taken in connection with the accompanying drawings, and from the claims.

BRIEF DESCRIPTION OF THE DRAWINGS

The advantages described herein will be more fully understood by reading an example of an embodiment in which the invention is used to advantage, referred to herein as the Description of Preferred Embodiment(s), with reference to the drawings, wherein.

DESCRIPTION OF PREFERRED EMBODIMENT(S)

Figure 1:
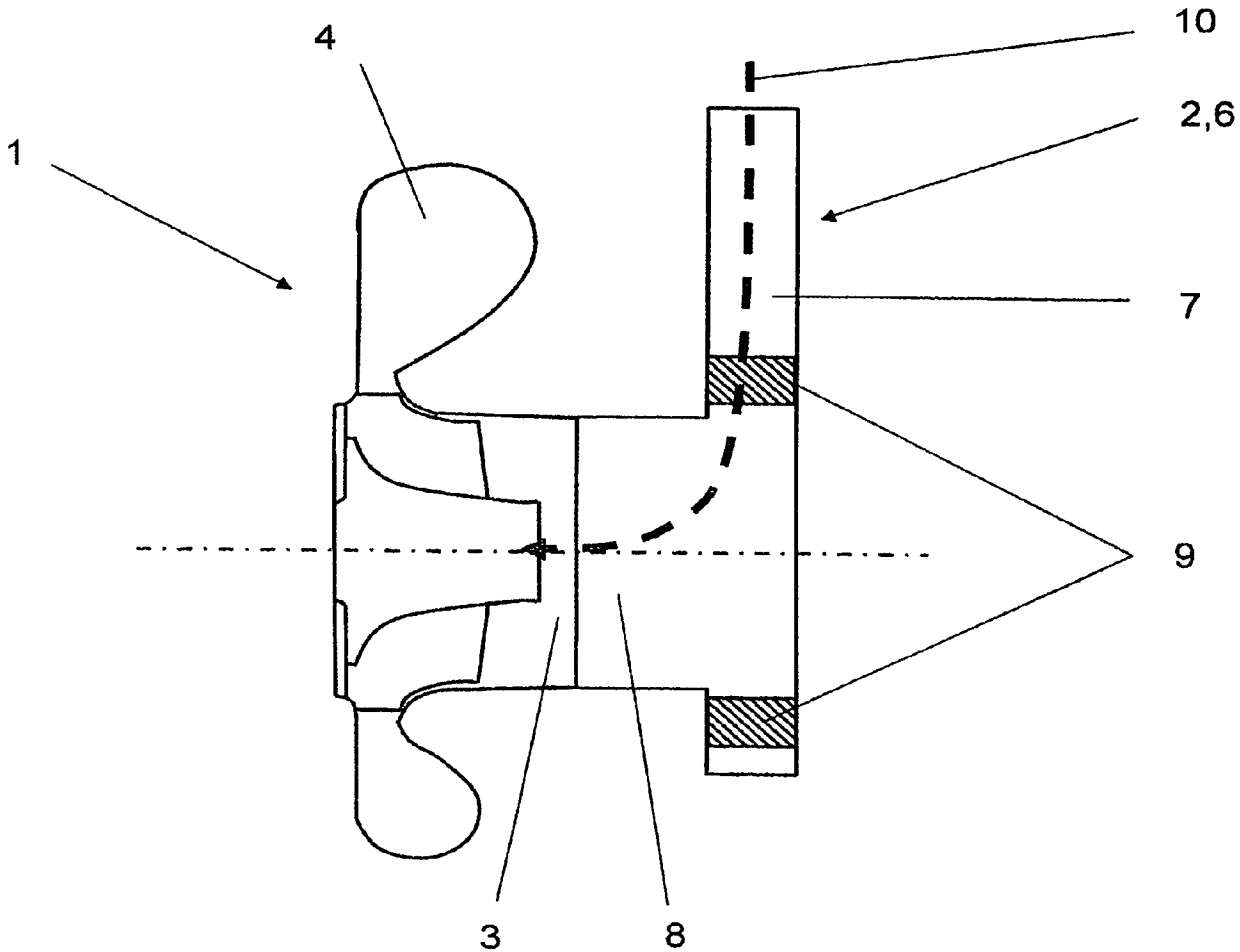
FIG. 1 shows a radial compressor having an upstream swirl generator.

FIG. 1 shows a radial compressor 1 having an upstream swirl generator 2. The radial compressor 1 has a suction-side opening 3 and a pressure side 4. The suction-side opening 3 is assigned an approach flow line 6, which has an inlet portion 7 and at least one outlet opening 8, which latter emerges in the suction-side opening 3. The approach flow line 6 is configured as a swirl generator 2. The swirl generator 2, with its inlet portion 7, is angularly configured relative to the outlet opening 8, the swirl generator 2 having adjustable baffle plates 9, which are arranged concentrically around the outlet opening 8 (described in more detail in FIG. 2 below). In a preferred embodiment, the inlet portion 7 is arranged at a right angle to the outlet opening 8, so that a 90° flow deflection of a flow medium is obtained. The flow deflection is represented in FIG. 1, by way of example, as the flow arrow 10. Of course, the inlet portion 7 can be arranged at any sensible angle, preferably at an acute angle ($0°<\alpha<90°$) to the outlet opening 8.

Figures 2, 3:
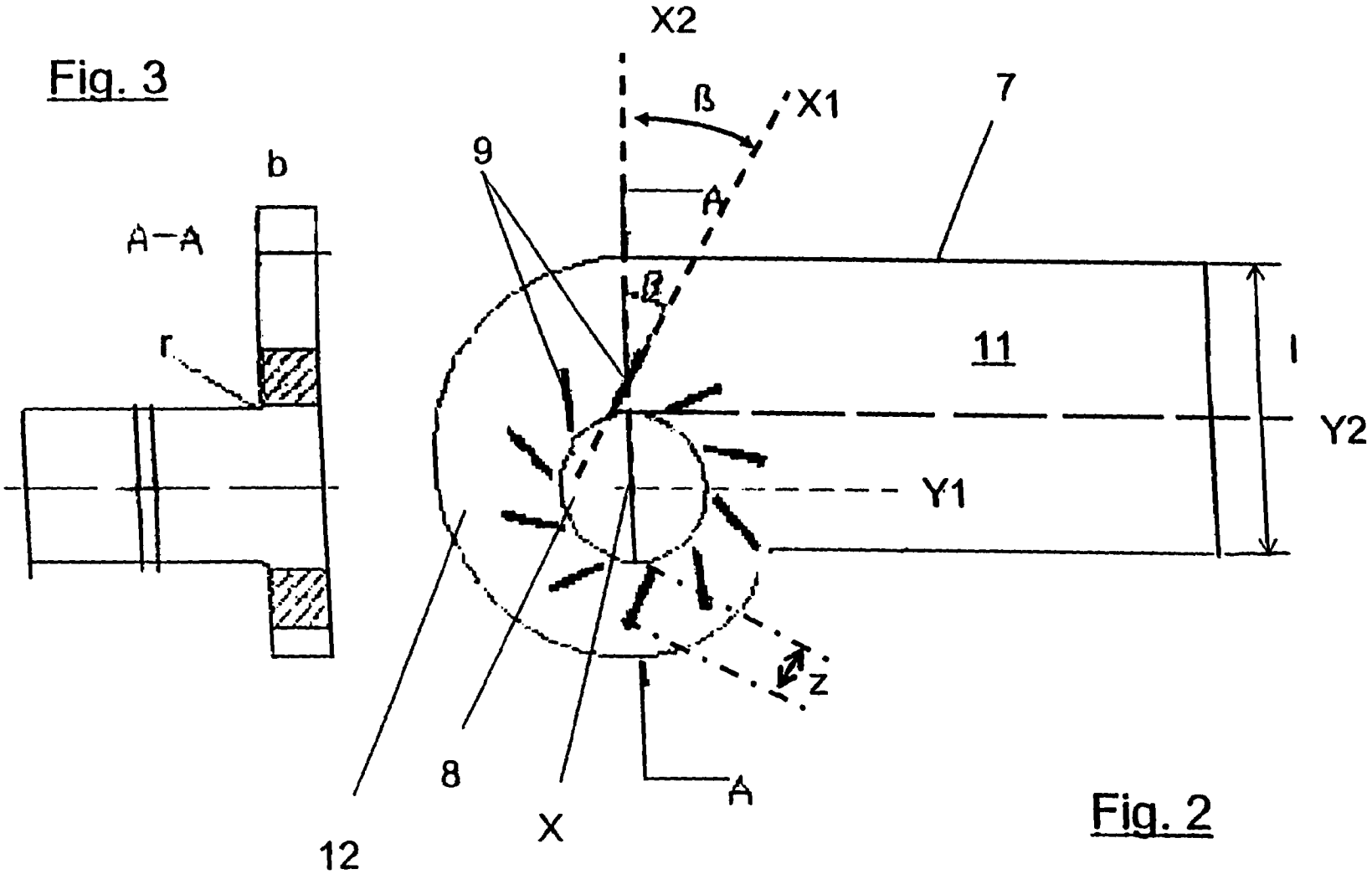
FIG. 2 shows the swirl generator from FIG. 1 in longitudinal section, as a single detail.
FIG. 3 shows a view of the swirl generator from FIG. 2 along the line A of FIG. 2.

The swirl generator 2, with its inlet portion 7, has a first region 11, which, viewed in longitudinal section, is of substantially rectangular configuration. The first region 11 passes into a second region 12, which, viewed in longitudinal section, is of substantially round configuration, the outlet opening 8, which, viewed in longitudinal section, is of circular configuration, being made in the second region 12. The swirl generator 2, viewed in longitudinal section, is thus preferably configured as a spiral housing (FIG. 2). The outlet opening 8 is arranged with its center line Y1 axially offset relative to a center line Y2 of the first region 11.

In the embodiment represented in FIG. 2, the swirl generator 2 has on its inlet portion 7 an intake cross-sectional area which preferably roughly corresponds to a discharge cross-sectional area of the outlet opening 8. In a preferred embodiment, the outlet opening 8 has an outlet diameter of 39.2 mm, the first region 11 of the inlet portion 7 having a width b and a length l, which form the intake cross-sectional area.

The outlet diameter of the outlet opening 8 is matched to a diameter of the suction-side opening 3, so that it is easily conceivable for the swirl generator 2 which is represented by way of example, in case of different diameter measurements for the suction side opening 3 of compressors, to be correspondingly configured.

In the illustrative embodiment which is represented by way of example, the baffle plates 9 have a length z of 16 mm. The baffle plates 9 may also, of course, have a different length measurement. The baffle plates 9 are disposed rotatably within the swirl generator 2, preferably in its second region 12, and can be set at a blade angle β. The blade angle β is measured between a longitudinal axis X1 of the baffle plate 9 and a connecting line X2 running from a respective rotational axis of the baffle plate 9 to a center axis X of the outlet opening 8. In the preferred illustrative embodiment, ten baffle plates 9 are arranged concentrically around the outlet opening 8. The baffle plates 9 are preferably adjustable within a blade angle range β from −60° to 60°.

FIG. 3 shows a sectional view along the line A from FIG. 2. It can be seen from FIG. 3 that a radius r at the generator discharge has a measurement of 1.5 mm. Said measurements can be adapted, of course, to the respective conditions.

The swirl generator 2 can be regarded as a sharp 90° bend, which, viewed in longitudinal section, has a substantially rectangular flow box with a circular outlet, which latter can be configured as an outlet pipe emerging directly in the suction-side opening 3 of the compressor 1. The swirl generator 2 according to the invention allows the available construction space to be utilized as efficiently as possible, baffle plates 9 having additionally been integrated into the severe flow deflection so as to influence the position of the surge limit. In the case of a negative swirl, improved pumping characteristics are thus obtained. With small swirl, an obtainable pressure ratio can likewise be slightly improved in comparison to the basic characteristic diagram.

By means of the swirl generator 2 according to the invention, the installation situation of the radial compressor 1, especially of a radial compressor 1 configured as a turbocharger, with a 90°-bent approach flow of the compressor 1 is allowed, without any adverse effect upon the general behavior of the compressor 1. At the same time, with the swirl generator 2 according to the invention, the position of the surge limit is able to be improved.

In the represented illustrative embodiment, the swirl generator 2 has a single outlet opening 8. A second outlet opening can, of course, be provided in order to equip a further radial compressor 1 with the swirl generator 2 according to the invention. The second outlet opening could be disposed on a side opposite to the first outlet opening 8 and preferably congruent to the first outlet opening 8, so that one of the exemplary compressors is flowed against with a positive swirl and the other exemplary compressor with a negative swirl. Furthermore, that assembly position of the inlet portion 7 which is shown in the represented illustrative embodiment is not limited thereto. The swirl generator 2 can, of course, be fitted with its inlet portion 7 freely rotatable around the center axis X and variable in all positions. In addition, the baffle plates 9 can also be profiled.

This concludes the description of the invention. The reading of it by those skilled in the art would bring to mind many alterations and modifications without departing from the spirit and the scope of the invention. Accordingly, it is intended that the scope of the invention be defined by the following claims:

The invention claimed is:

1. A turbocharger system for an internal combustion engine, comprising:

a radial compressor having a suction-side opening; and a swirl generator comprising an outlet portion facing said suction-side opening on said radial compressor, and an inlet portion angularly configured relative to said outlet portion, said swirl generator further comprising a plurality of adjustable baffle plates arranged concentrically in a loop around said outlet portion; and wherein the baffle plates have surfaces disposed to intercept a flow of air passing from the inlet portion to the outlet portion of the swirl generator wherein each one of the surfaces is at a plate angle β, the blade angle β being measured between a longitudinal axis of the plate and a connecting line running from a respective point on the plate to a center axis of the outlet portion.

2. The system recited in claim 1 wherein the each one plates is adjustable within an angle range β from −60° to 60°.

3. The system recited in claim 2 wherein the inlet portion has a longitudinal axis and wherein the loop is disposed about an axis offset from the longitudinal axis.

4. A turbocharger system for an internal combustion engine, comprising:

a radial compressor having a suction-side opening; and a swirl generator comprising an outlet portion facing said suction-side opening of said radial compressor, and an inlet portion angularly configured relative to said outlet portion, said swirl generator further comprising a plurality of baffle plates and wherein the baffle plates have surfaces disposed to intercept a flow of air passing from the inlet portion to the outlet portion of the swirl generator; and wherein each one of the surfaces is at a plate angle β the blade angle β being measured between a longitudinal axis of the plate and a connecting line running from a respective point on the plate to a center axis of the outlet portion.

5. The system recited in claim 4 wherein the each one plates is adjustable within an angle range β from −60° to 60°.

* * * * *